US005507043A

United States Patent [19]

Howe

[11] Patent Number: 5,507,043

[45] Date of Patent: Apr. 16, 1996

[54] DEVICE FOR SHAPING AND RETENTION OF HAND COVERINGS

[76] Inventor: Paul S. Howe, 1417 Gibbons Dr., Alameda, Calif. 94501

[21] Appl. No.: 217,709

[22] Filed: Mar. 25, 1994

[51] Int. Cl.[6] ..... A41D 19/00

[52] U.S. Cl. ..... 2/159; 2/162; 24/30.5 P

[58] Field of Search ..... 2/159, 160, 161.1, 2/161.2, 161.5, 16, 17, 162, 158, 161.6; 24/3 N, 16 PB, 30.5 P, 306

[56] References Cited

U.S. PATENT DOCUMENTS

| | | | |
|---|---|---|---|
| 1,642,311 | 9/1927 | Richardson . | |
| 1,836,223 | 12/1931 | Burns | 294/25 |
| 2,709,257 | 5/1955 | McKinney | 2/160 |
| 3,178,724 | 4/1965 | Perschke | 2/16 |
| 3,302,258 | 2/1967 | Meyer | 24/16 PB |
| 3,606,343 | 9/1971 | Lemon | 273/189 R |
| 3,906,941 | 9/1975 | Cook, Jr. | 24/30.5 P |
| 4,435,008 | 3/1984 | Black | 294/25 |
| 4,912,779 | 4/1990 | Laird | 2/12 |
| 4,958,758 | 9/1990 | Tipple et al. | 24/306 |
| 5,064,198 | 11/1991 | Szabo | 273/189 R |
| 5,301,806 | 4/1994 | Olson | 2/159 |

FOREIGN PATENT DOCUMENTS

| | | | |
|---|---|---|---|
| 652152 | 1/1963 | Italy | 24/30.5 P |

*Primary Examiner*—C. D. Crowder
*Assistant Examiner*—Larry D. Worrell, Jr.

[57] ABSTRACT

A device made of thin, flat, flexible material for shaping various sheet materials into coverings for the human hand. A strap long enough to encircle the smallest circumference of the wrist has means for adjustably fastening its opposite ends. Extending outward from the wrist strap is a connector with a through hole or slit at its extreme end. Said hole or slit is large enough to encircle the the base of the thumb near the level of the joint of the thumb metacarpal bone and proximal thumb phalanx bone. The wrist strap and thumb hole are placed over a suitable flexible sheet material to shape and retain said material into a mitten-like covering on the hand. The hand covering is thereby retained from dislodgement and the grasping function of the human opposable thumb is thereby facilitated.

8 Claims, 4 Drawing Sheets

DEVICE FOR SHAPING AND RETENTION OF HAND COVERINGS

BACKGROUND-FIELD OF INVENTION

This invention relates to articles worn on the human body that provide or facilitate full or partial flexible coverings for the human hand.

BACKGROUND-DESCRIPTION OF PRIOR ART

Hand coverings in the form of gloves and mittens have been in existence for millennia. The materials used to make gloves and mittens are myriad.

Many variations of the concepts of gloves and mittens have been devised to meet specific circumstances, such as protection of the hand from cold, heat, mechanical or chemical trauma, or from biological contamination. Gloves and mittens are also used extensively for protection of the immediate environment from contamination by the hand.

In addition to full gloves and mittens, there are in existence many devices which are worn about the wrist and fingers, and which enhance the ability of the hand to accomplish certain functions, as in aids to sports activities ( U.S. Pat. Nos. 5,064,198—3,606,343—3,178,724), aids for grasping or carrying objects ( U.S. Pat. Nos. 4,435,008—1, 836,223—1,642,311), and aids to protect the hand in specific ways. Partial gloves or mittens which do not fully cover the whole hand, however, are not generally useful for protecting the hand from contamination, or for protecting the environment from the hand.

All gloves or mittens, whether providing full or partial hand covering, have several disadvantages. They must conform to the shape of the hand both to allow the hand to function and to prevent the garment from inadvertently being dislodged from the hand. Therefore the material which constitutes the hand covering itself must generally be shaped in manufacture, with the intention of it being used as a glove or mitten. There are inherent costs of manufacture, waste, storage and distribution, even for a hand covering used for the simplest of tasks, or the briefest of time. Also, a manufactured glove or mitten, unless made to do so, generally does not cover very far up the arm. Such coverage might be desirable for some purposes, as when applying spray insecticide in gardens.

A more general form of hand covering could be made from any flexible sheet material if it can be made to conform to the shape of the hand. In order to facilitate even the simple grasping function made possible by an opposable thumb, the sheet material must be shaped to the hand and retained on the hand by some additional means. These functions of shaping and retention have been achieved by lengths of wire, rubber, tape, tape with adhesives, string or other flexible materials. These other means must be suitable for fastening around the wrist and one or more digits or the thumb. These other means can be awkward to apply, especially with one hand. They can be uncomfortable to wear, may result in trauma to the hand, and can be difficult to remove. A common rubber band, in particular, can result in restriction of blood circulation when employed in this fashion. Twisted wire can be hazardous to use for this purpose, especially by children.

To date, when a hand covering is desired for one of many reasons, there are only two choices available.

First, one can use a pre-manufactured glove or mitten. For many mundane, short tasks this first choice is more expensive and wasteful than it needs to be. This choice is not available if one has not manufactured or bought and stored the appropriate type and size of glove or mitten.

Second, one can use a flexible sheet material not specifically manufactured for hand covering, and try to keep it in place on the hand utilizing either nothing or a separate object for shaping and retention. This choice of using makeshift means of shaping and retention can be difficult to apply and remove, awkward to use, time consuming, uncomfortable, dangerous and ultimately not effective for the intended purpose. An attempt to use objects as described by the patents above could be made. However, none of them are specifically intended to be used in the current manner. In fact, their intended uses dictate a heavier and more complicated structure than necessary for the currently described function.

Until now, there did not exist a device, such as my invention, specifically designed to quickly and easily facilitate the employment of readily available flexible sheet materials as hand coverings.

DRAWING FIGURES

FIG. 1(*b*) shows the device made from two pieces of attached material.

FIG. 3(*b*) shows the device of FIG. 3(*a*) after being removed from the sheet and unfolded prior to being placed over the hand covering.

REFERENCE NUMERALS IN DRAWINGS

Figure 1A:
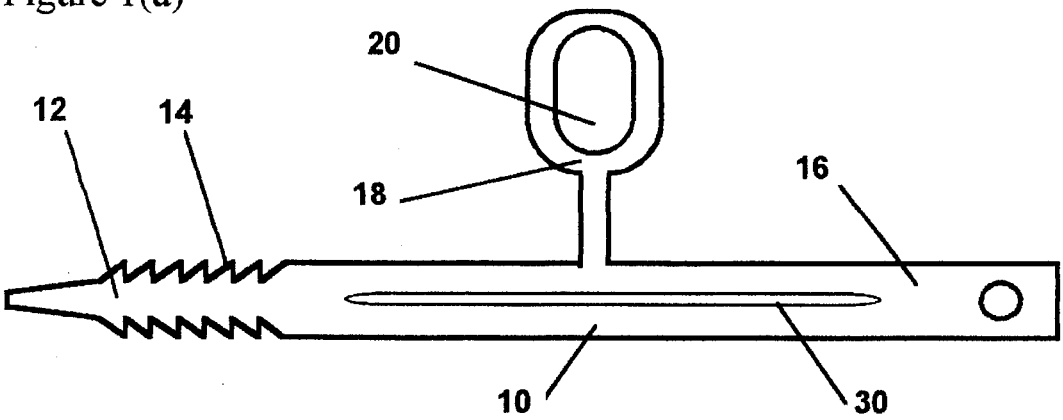
FIG. 1(*a*) shows the basic configuration of the current device as made from one piece of material plus optional adhesive.

10 wrist strap 12 narrow end of strap
14 protrusions 16 hole end of strap
18 connector 20 thumb hole or slit
22 angled section of strap 24 angled section of strap
26 slot 28 slit
30 adhesive 32 attachment
34 first serpentine cut 36 second serpentine cut
38 thumb loop 40 hole
42 midsection.

OBJECTS ADVANTAGES

Accordingly, several objects and advantages of this new type of product, a device for shaping and retention of hand coverings, are:

1) To provide a means of conforming flexible sheet material to the human hand.

2) To shape the sheet material hand covering so that the natural grasping function of the opposable human thumb is facilitated.

3) To provide retention of the hand covering on the hand and prevent the hand coveting from being inadvertently dislodged from the hand.

4) To enable any selected sheet material, which is flexible enough to be shaped over the hand, to perform effectively the intended hand coveting function in a given environment. Such coverings might include woven materials as well as non-porous sheets.

5) To provide shaping and retention for hand coverings by means of a single size device with adjustability so that it will comfortably fit many sizes and shapes of hands.

6) To provide such a device which can be quickly and easily applied and removed, and which could but need not be itself affixed or adherent to the sheet material hand covering.

7) To provide such a device which can be made of almost any flexible material, and which can be supplied to distributors or end-users separately or in break-off sheets.

8) To provide such a device which is inexpensive to manufacture, store, and distribute so that it can be marketed along with trash bags or food storage bags, or similar items.

9) To provide such a device which can be easily carried and stored indefinitely. It will thereby be available for use on short notice, in combination with whatever sheet materials are commonly available, such as the ubiquitous plastic grocery bag.

10) To provide such a device which when combined with a sufficiently large hand covering, will allow uninterrupted covering to extend up the arm.

Other objects and advantages are to provide a device for certain merchants which, even when provided with a logo or brand name, is so inexpensive it can be given away for advertising purposes. They might include paint stores, hardware stores, pet shops, feed stores, plant nurseries, and the like. When marketed in conjunction with existing items such as plastic garbage bags or food storage bags, the device would be an inexpensive and easy way to increase market share of a particular brand.

The device could be employed to hold medicaments, lotions, or even ice on the hand, or to protect medical dressings.

A major advantage of the device is that it will enable hand covering for persons who cannot use gloves due to deformities of the fingers.

Further objects and advantages of the device will become apparent from a consideration of the drawings and ensuing description.

DESCRIPTION FIG. 1 to 4

Figure 1B:
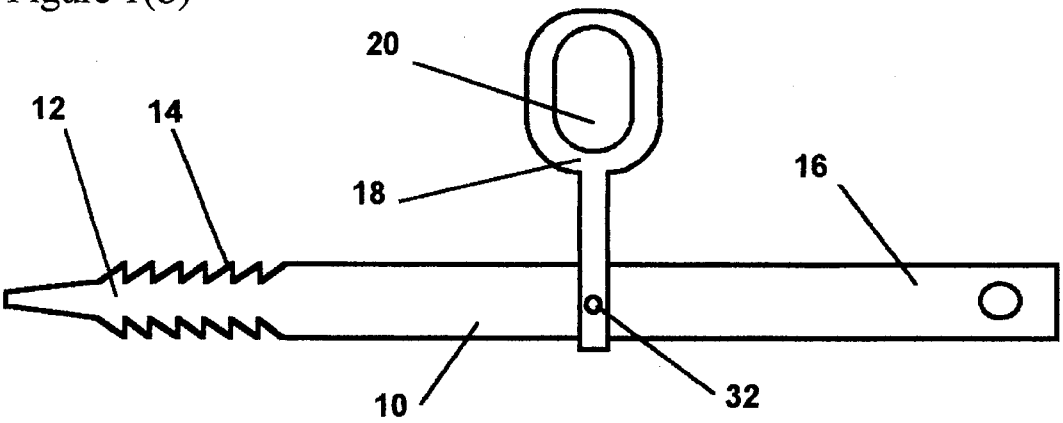

The preferred embodiment of the present invention is shown in FIG 1(*a*). The device is made of thin fiat flexible material typically 0.25 to 1 millimeters thick. The device can consist of a material that can be bent without fracturing, such as polyethylene, polypropylene, vinyl, nylon, rubber, leather, various impregnated or laminated fibrous materials, various plasticized materials, cardboard, paper, etc.

The basic structure has a wrist strap 10 that is long enough to encircle the wrist. Typical wrist strap dimensions would be about eleven inches long and three-eights to three-quarters of an inch wide. In this embodiment one end of the wrist strap, the narrow end 12, is narrow at the extreme end and further back from this end the strap has a series of shaped protrusions 14 on both edges. The other end of the wrist strap, the hole end 16, has a hole of sufficient size to let the narrow end of the strap be passed through and let the protrusions of the narrow end engage the sides of the hole in the hole end, thereby holding the narrow end in place. In this embodiment the protrusions and the hole form the means of making the wrist strap adjustable in circumference.

Located along the mid-length of the wrist strap there is a connector 18 which extends approximately perpendicular to the strap. The connector may be continuous with the wrist strap or it may be attached 32 to the wrist strap, as shown in FIG. 1(*b*). The connector is about the length of the metacarpal bone of the thumb plus the diameter of the thumb. The connector contains a hole or slit 20 for the enclosure of the base of the thumb. The connector can be of varying width as long as the thumb hole or slit allows the thumb to pass through.

The length of the connector should be adequate to allow the thumb hole to loosely encircle the base of the thumb and still allow the wrist strap to encircle the wrist at the level of the smallest circumference of the wrist.

The length of the connector should not be so long as to allow, during use, the thumb hole or slit to move from the base of the thumb toward the tip of the thumb of an average hand.

Figure 2:
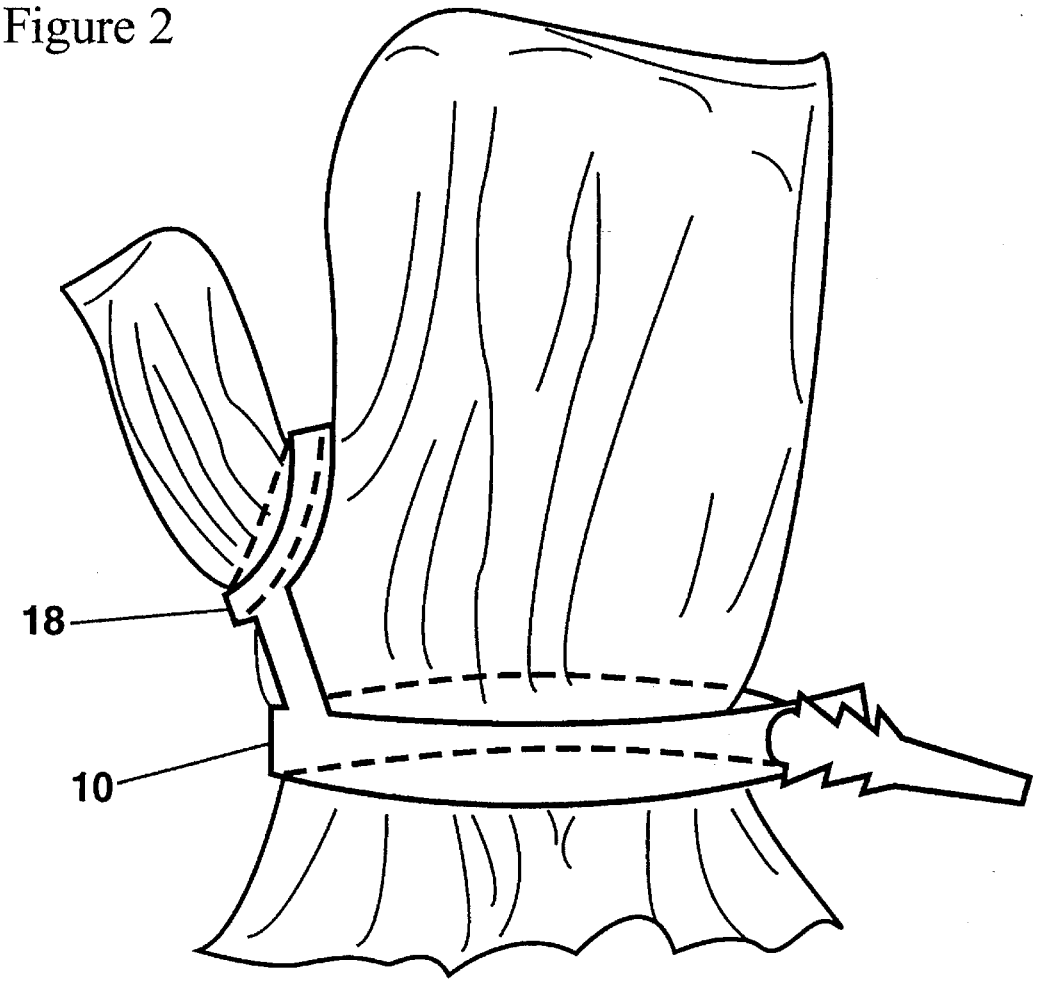
FIG. 2 shows a similar device in place around a flexible material shaped as it would be if it covered a hand.

FIG. 2 shows this embodiment in place over a flexible hand covering shaped as if on a human hand.

Figure 3A:
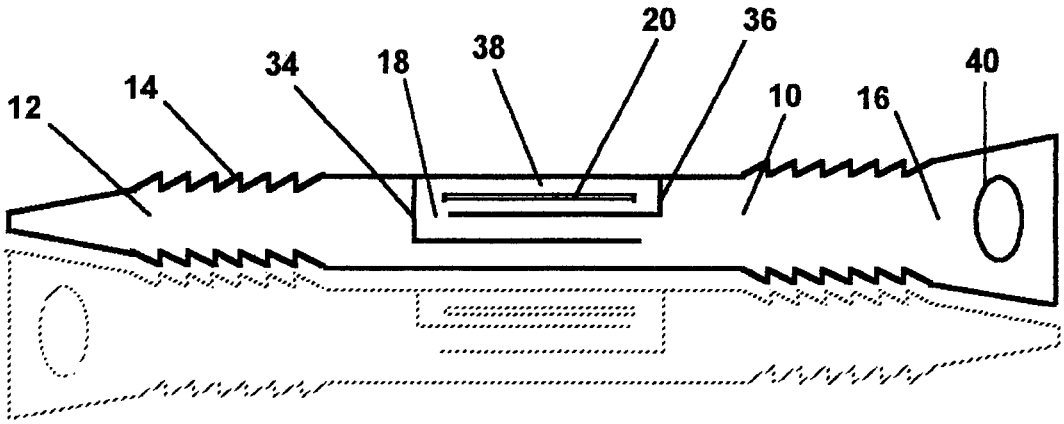
FIG. 3(*a*) shows a device shaped so that the connector will be formed from the material near the middle length of the wrist strap. Individual units alternate in direction to facilitate manufacture from a continuous sheet.
Figure 3B:
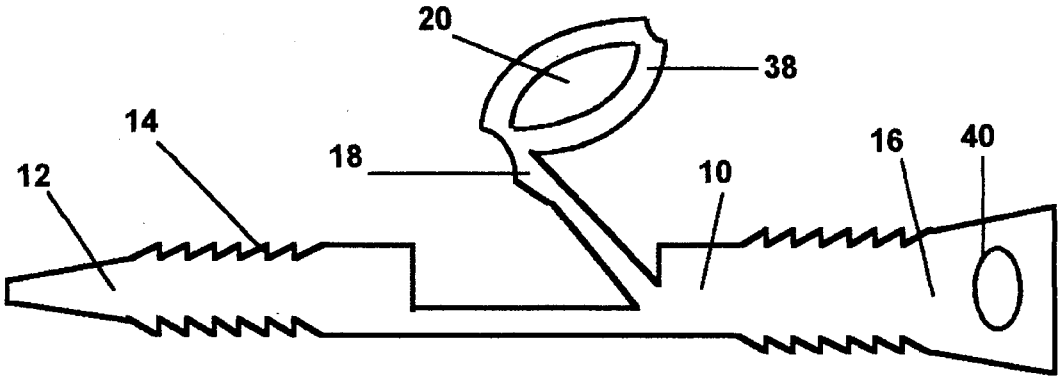

Another embodiment is shown in FIG. 3(*a*) and 3(*b*). Here the length and width of the wrist strap 10 are about the same as in FIG. 1(*a*). First and second serpentine cuts 34 and 36, respectively, are arranged on strap 10. Each cut begins along the same longitudinal side of strap 10, and terminates therein. Cuts 34 and 36, in conjunction with slit 20, form integral connector 18 and integral thumb loop 38, as shown in FIG. 3(*a*). Slit 20 does not intersect either cut 34 or cut 36. Strap 10 is made of a flexible material, so that thumb loop 38 and connector 18 are extendable away from the main body of strap 10, as shown in FIG. 3(*b*). Strap 10 also includes a hole 40 at end 16. In this embodiment, cut 34 is L-shaped, whereas cut 36 is reversed L-shaped. Cut 36 is smaller than cut 34, so that it is nestled within cut 34 without intersecting it. Alternatively, serpentine cuts of other shapes, or just one cut of a suitable shape, can be used for forming integral connector 18 and integral thumb loop 38. This embodiment allows the device to be simply manufactured from a continuous sheet of material, with each succeeding device being oriented in the opposite direction as shown in FIG. 3(*a*). In this embodiment the series of protrusions in the edges of the hole end of the wrist strap are not functional in use but are the result of this type of manufacture.

Figure 4:
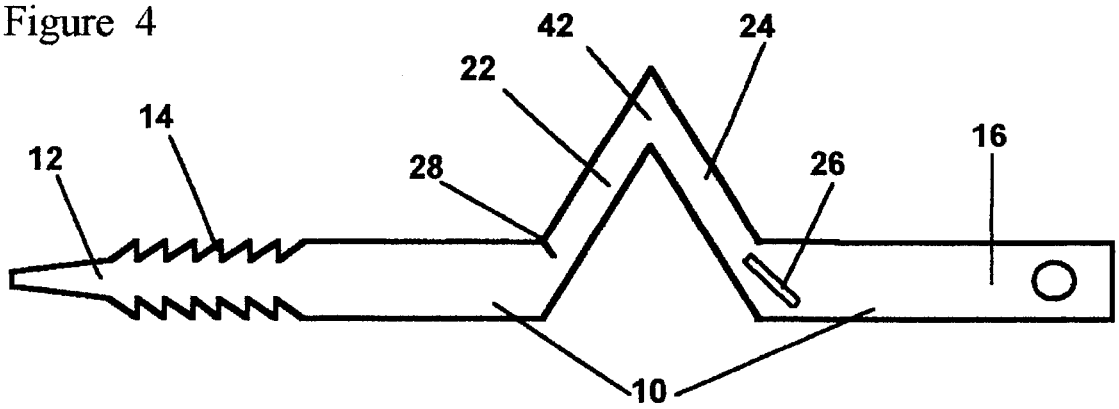
FIG. 4 shows an alternative embodiment for the current device, which also can be manufactured from a continuous sheet. A slot and slit are provided so that a stable wrist strap and thumb hole can be simply formed.

Another embodiment is shown in FIG. 4. A continuous wrist strap analogous to the wrist strap of FIG. 1(*a*) has two angled sections near its mid-portion. This wrist strap is necessarily about two to three inches longer than the wrist straps of preceding embodiments. Each end of the wrist strap is like the ends 12 and 16 shown in FIG 1(*a*). The two sides of the connector are formed by the two angled sections, 22 and 24, which cooperate to form a V-shaped midsection 42. There is a slot 26 in the wrist strap at the juncture of one angled section 24 with the hole end 16 of the wrist strap. This slot allows through passage of the narrow end of the wrist strap 12. A small slit is in the inside angle of the juncture of the other angled section 22 with the narrow end of the wrist strap, to enable formation of a stable wrist strap, connector and and thumb hole. If the two angled sections, 22 and 24, are equal in size, slight changes to the edges of this embodiment would allow the device to be manufactured from a continuous sheet of material much as the embodiment shown in FIG. 3(*a*) and 3(*b*).

For all of the embodiments described above there are various possibilities as to the width of wrist strap and connector, the shape of the connector, the shape and size of the thumb hole, the placement of the connector along the length of wrist strap and the means of configuring and implementing the adjustable length feature of the wrist strap. If desired an adhesive 30 could be applied on the side of any wrist strap for greater retention.

When comparing the current invention to similar prior devices the closest analogue design to the current invention is that of Perschke, U.S. Pat. No. 3,178,724, a hand guard for gymnasts. However that device is intrinsically required to be much larger and much more rugged, and in fact incorporates stress relief features. Unlike my invention hand guarding is provided by that device itself not by the device in combination with other materials. If employed in the same manner as my invention it would have to be made smaller to fit the thumb effectively and the straps would have to be set at a different angle to avoid riding up on the thumb. In addition, it is not apparent how any of the designs in the patents cited above could be manufactured solely from one type of material, but my invention can be.

From the description it can be seen that the device has several advantages:

1) The design is very simple, flexible and can be scaled to fit almost any human hand.

2) The design is simple to manufacture and can be produced from only one type of material if so desired.

3) The design can be made to conform to standard manufacturing methods, such as the stamping of trash bag ties from continuous sheets of plastic. This feature means very little left over material is generated in manufacture.

4) The design can incorporate standard designs for making adjustable wrist straps.

5) The resulting product is so simple and inexpensive to manufacture that it can be given away as a promotional gratuity, or sold along with other appropriate products to increase their market share.

6) The device can be carried and stored almost anywhere, so it will likely be available and actually used.

7) The simplicity and low cost of the design will allow people in all areas of the world to use available items as hand coverings, possibly allowing better hygiene in areas where little now exists.

OPERATION

The flexible sheet material to serve as the hand covering is first placed over the hand. The portion surrounding the thumb is adjusted to gather around the base of the thumb. The thumb hole in the device is then placed over the hand covering and thumb, and also pressed or pulled down to encircle the base of the thumb. Proper encirclement occurs at the level of the joint of the thumb metacarpal bone and proximal thumb phalanx bone. The wrist strap is then made to encircle the hand covering and wrist near the level of the smallest circumference of the wrist. Using the embodiment shown in FIG. 1(*a*), the narrow end of the wrist strap is placed in the hole of the opposite end of the wrist strap and pulled through. The protrusions on the narrow end 14 engage the sides of the hole in the hole end 16 and resist disengagement. The wrist strap is adjusted to be snug but not tight, so that the hand covering and the device will resist being dislodged from the hand.

Removal is accomplished by a reversal of the above procedure. If the device is made of appropriate material, the device may be removed by simply pulling on the middle of the wrist strap until it physically breaks or the protrusions disengage from the sides of the hole. If the device is removed intact it can be reused. If the mitten shape is preserved, the whole combination can be placed back on the hand.

The embodiment of FIG. 3(*a*) and 3(*b*) is placed on the hand in the same manner, after first unfolding the connector which incorporates the thumb hole.

The embodiment of FIG. 4 requires that the narrow end 12 of the wrist strap first be pulled through the slot 26 until the slit 28 engages one side of the slot. The resulting configuration, which now includes a stable wrist strap and connector with thumb hole, is then utilized as are the embodiments of FIG. 1(*a*) and 1(*b*) and FIG. 3(*a*) and 3(*b*).

In other possible embodiments that utilize a different method or configuration to obtain an adjustable wrist strap closure, the difference in placement and removal will be appropriate for that type of closure.

SUMMARY, RAMIFICATIONS AND SCOPE

It is evident that this new device, which allows any flexible sheet material to be used as a functional hand covering, will be used in many disparate situations and for a variety of reasons. Although simple in design and inexpensive to manufacture and distribute, the device adds important dimensions to simple hand covering, namely the two advantages of preserving the function of an opposable thumb for grasping, and providing secure but comfortable resistance to dislodgement.

In developed and developing countries alike the most probable use for the device will be to expand the usefulness of the millions of plastic bags distributed by retailers. Increased levels of hygiene and multiple uses for heretofore expendable bags will thus be conferred by the availability of the device. Protection of the hands from a dirty world and protection of the world from dirty hands, at cheap prices, are now goals within reach. The wide scope of practical uses and the simplicity of design, combined with the promotional advertising potential should make the current device a desirable commercial product.

Although the description above contains specificities, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. A strap device for shaping and retaining a covering wrapped around a hand of a user, comprising:

an elongated wrist strap having longitudinal sides and first and second ends, said second end having a hole herein for receiving said first end;

a serpentine cut arranged on said wrist strap; and a slit arranged within said serpentine cut without intersecting aid serpentine cut, so that said serpentine cut and said slit cooperate to form an integral thumb loop and an integral connector, said thumb loop being extendible away from said wrist strap, said thumb loop being connected to said wrist strap by said connector when said thumb loop is extended;

whereby when said covering is wrapped around said hand, said strap device is usable for shaping and securing said covering on said hand by extending said thumb loop away from said wrist strap, positioning said thumb loop around a bas of said thumb, wrapping said wrist strap around a wrist of said user, and passing said first end of said wrist strap through said hole in said second end.

2. The strap device of claim 1 wherein said wrist strap is made of a flexible material.

3. The strap device of claim 1, further including an adhesive disposed on a side of said wrist strap.

4. The strap device of claim 1, further including a plurality of protrusions arranged along said longitudinal sides adjacent said first end of said wrist strap for locking said first end within said hole when said first end is positioned within said hole.

5. A strap device for shaping and retaining a covering wrapped around a hand of a user, comprising:

an elongated wrist strap having longitudinal sides and first and second ends, said second end having a hole therein for receiving said first end;

an L-shaped cut arranged on said wrist strap, said L-shaped cut beginning along one of said longitudinal sides and terminating within said wrist strap;

a reversed L-shaped cut arranged on said wrist strap, said reversed L-shaped cut being smaller than said L-shaped cut, said reversed L-shaped cut beginning along said one of said longitudinal sides and terminating within said wrist strap, said reversed L-shaped cut being nestled within said L-shaped cut without intersecting said L-shaped cut; and a slit arranged between said reversed L-shaped cut and said one of said longitudinal sides without intersecting said cuts, so that said cuts and said slit cooperate to form an integral thumb loop and an integral connector, said thumb loop being extendible away from said wrist strap, said thumb loop being connected to said wrist strap by said connector when said thumb loop is extended;

whereby when said covering is wrapped around said hand, said strap device is usable for shaping and securing said covering on said hand by extending said thumb loop away from said wrist strap, positioning said thumb loop around a base of said thumb, wrapping said wrist strap around a wrist of said user, and passing said first end of said wrist strap through said hole in said second end.

6. The strap device of claim 5 wherein said wrist strap is made of a flexible material.

7. The strap device of claim 5, further including an adhesive disposed on a side of said wrist strap.

8. The strap device of claim 5, further including a plurality of protrusions arranged along said longitudinal sides adjacent said first end of said wrist strap for locking said first end within said hole when said first end is positioned within said hole.

* * * * *